US011328574B2

(12) United States Patent
Zhang et al.

(10) Patent No.: US 11,328,574 B2
(45) Date of Patent: May 10, 2022

(54) ALARM AND NOTIFICATION GENERATION DEVICES, METHODS, AND SYSTEMS

(71) Applicants: Weilin Zhang, Morris Plains, NJ (US); Peng Jiang, Morris Plains, NJ (US); Zhenjun Mei, Morris Plains, NJ (US); Dapeng Li, Morris Plains, NJ (US); Qiong Gao, Morris Plains, NJ (US); HONEYWELL INTERNATIONAL INC., Morris Plains, NJ (US)

(72) Inventors: Weilin Zhang, Morris Plains, NJ (US); Peng Jiang, Morris Plains, NJ (US); Zhenjun Mei, Morris Plains, NJ (US); Dapeng Li, Morris Plains, NJ (US); Qiong Gao, Morris Plains, NJ (US)

(73) Assignee: HONEYWELL INTERNATIONAL INC., Charlotte, NC (US)

( * ) Notice: Subject to any disclaimer, the term of this patent is extended or adjusted under 35 U.S.C. 154(b) by 119 days.

(21) Appl. No.: 16/499,974

(22) PCT Filed: Apr. 3, 2017

(86) PCT No.: PCT/CN2017/079391

§ 371 (c)(1),
(2) Date: Oct. 1, 2019

(87) PCT Pub. No.: WO2018/184130

PCT Pub. Date: Oct. 11, 2018

(65) Prior Publication Data

US 2020/0380846 A1 Dec. 3, 2020

(51) Int. Cl.
*G08B 21/18* (2006.01)
*G08B 23/00* (2006.01)
(Continued)

(52) U.S. Cl.
CPC ..... *G08B 21/182* (2013.01); *G08B 23/00* (2013.01); *G08B 25/008* (2013.01); *G08B 25/08* (2013.01); *G08B 25/10* (2013.01)

(58) Field of Classification Search
None
See application file for complete search history.

(56) References Cited

U.S. PATENT DOCUMENTS 6,417,774 B1 * 7/2002 Hibbs ..... A62B 9/00 340/584
7,448,048 B1 * 11/2008 Nesamoney ..... G06Q 10/06 719/318
(Continued)

FOREIGN PATENT DOCUMENTS

CN 101783057 A 7/2010
CN 105681085 A 6/2016
(Continued)

OTHER PUBLICATIONS

International Search Report and Written Opinion for Application No. PCT/CN2017/079391 dated Dec. 29, 2017.

*Primary Examiner* — Carlos Garcia
(74) *Attorney, Agent, or Firm* — Seager, Tufte & Wickhem, LLP

(57) ABSTRACT

Devices, methods, and systems for alarm and notification generation are described herein. One computing device for alarm and notification generation includes a processor configured to identify a plurality of alarm set points for a system, wherein the plurality of alarm set points are threshold values for the system, generate an alarm template for the system, wherein the alarm template includes additional threshold values (e.g., special points, etc.) for the system, generate a rule data structure that includes the plurality of alarm set points for the system and the additional threshold values for the system, generate a first notification when a
(Continued)

value for the system meets or exceeds an alarm set point of the plurality of set points, and generate a second notification when the value for the system meets or exceeds the additional threshold values of the alarm template for the system.

18 Claims, 4 Drawing Sheets

(51) Int. Cl.

| | |
|---|---|
| ***G08B 25/00*** | (2006.01) |
| ***G08B 25/08*** | (2006.01) |
| ***G08B 25/10*** | (2006.01) |

(56) References Cited

U.S. PATENT DOCUMENTS

| | | | | |
|---|---|---|---|---|
| 9,196,141 | B1 * | 11/2015 | Schmidt | G08B 17/113 |
| 10,469,309 | B1 * | 11/2019 | Gupta | H04L 67/10 |
| 10,509,890 | B2 * | 12/2019 | Van Arkel | G06Q 10/10 |
| 2003/0001747 | A1 * | 1/2003 | Griffin | G01R 21/133 340/657 |
| 2012/0286955 | A1 * | 11/2012 | Welch | A61B 5/0205 340/573.1 |
| 2015/0149218 | A1 * | 5/2015 | Bayley | B60R 21/0136 705/4 |
| 2015/0325060 | A1 * | 11/2015 | Tart | G05B 9/02 340/679 |
| 2016/0077181 | A1 * | 3/2016 | Bielmeier | G01R 33/543 324/309 |
| 2016/0154395 | A1 * | 6/2016 | Llanos | G05B 23/02 700/108 |
| 2016/0335866 | A1 * | 11/2016 | Urrutia | G08B 17/10 |
| 2017/0116421 | A1 * | 4/2017 | M C et al. | G06F 16/23 |
| 2018/0167342 | A1 * | 6/2018 | Lewis | H04L 51/043 |
| 2019/0260869 | A1 * | 8/2019 | Nishioka | H04W 4/06 |

FOREIGN PATENT DOCUMENTS

| | | | |
|---|---|---|---|
| EP | 1623666 | A2 | 8/2006 |
| WO | 2018184130 | A1 | 10/2018 |

* cited by examiner

ALARM AND NOTIFICATION GENERATION DEVICES, METHODS, AND SYSTEMS

TECHNICAL FIELD

The present disclosure relates to devices, methods, and systems for alarm and notification generation.

BACKGROUND

Systems can utilize monitors to monitor a plurality of values for the system. For example, heating, ventilation, and air conditioning (HVAC) units can include a plurality of monitors to monitor a plurality of devices. The plurality of monitors can monitor a state of the plurality of devices. For example, the plurality of monitors can monitor performance of the plurality of devices. In some examples, the system can utilize the performance data of the plurality of devices to determine when one or more of the plurality of devices is not performing to a manufacturer specification. For example, the monitored performance can be utilized to determine when a device fails or is likely to fail.

The system can include pre-configured performance thresholds. When the performance data exceeds a performance threshold, the system can generate a notification to transmit to a user. For example, the system can identify a device that is performing outside the manufacturer specification and transmit a notification to the user. In some examples, the system can include instructions for the pre-configured performance thresholds that may be difficult to alter. Thus, it can be difficult for a user of the system to generate additional performance thresholds for the system without altering the instructions of the system.

DETAILED DESCRIPTION

Figure 1:
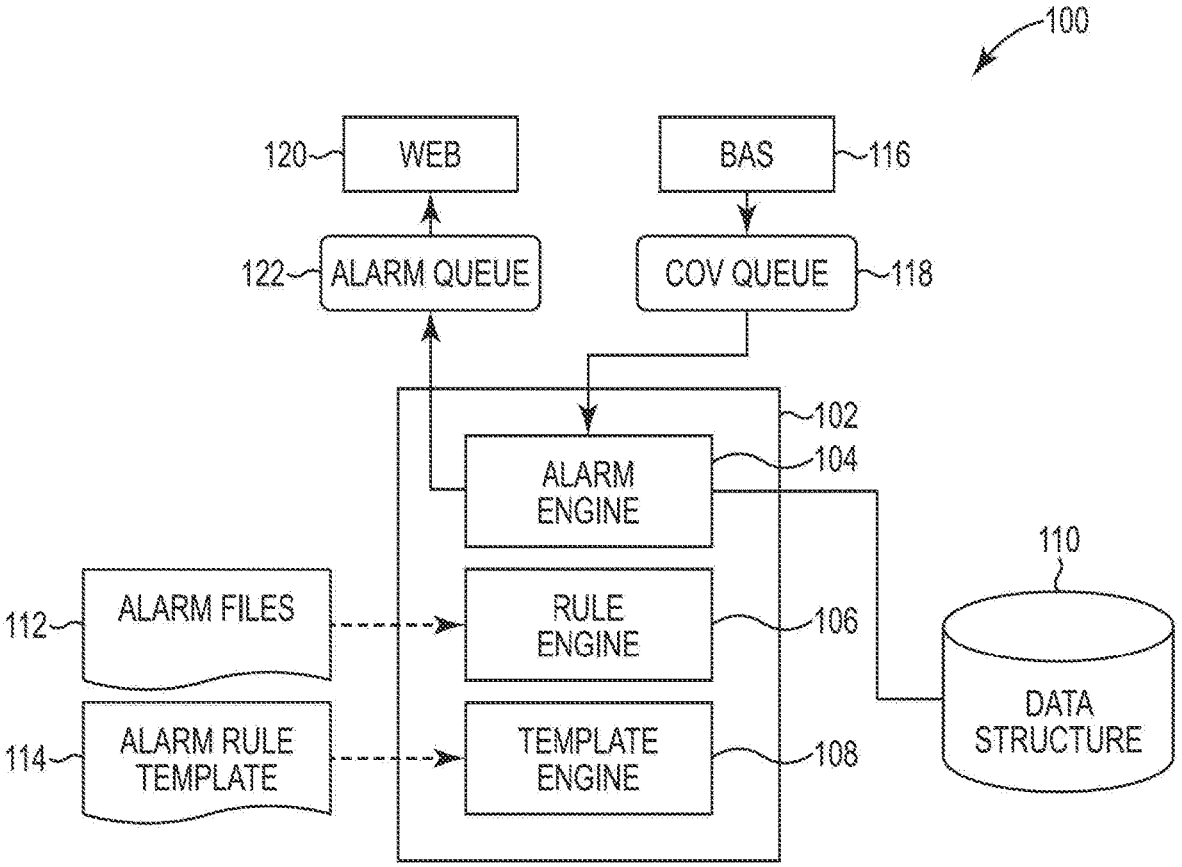
FIG. 1 is an example of a system for alarm and notification generation according to one or more embodiments of the present disclosure.

Alarm and notification generation devices, methods, and systems are described herein. For example, one or more embodiments include a computing device, comprising a memory and a processor configured to execute executable instructions stored in the memory to identify a plurality of alarm set points for a system, wherein the plurality of alarm set points are threshold values for the system, generate an alarm template for the system, wherein the alarm template includes additional threshold values for the system, generate a rule data structure that includes the plurality of alarm set points for the system and the additional threshold values for the system, generate a first notification when a value for the system meets or exceeds an alarm set point of the plurality of set points, and generate a second notification when the value for the system meets or exceeds the additional threshold values of the alarm template for the system.

Previous systems can utilize pre-configured alarm notifications that to alert a device or user when a device of the system is malfunctioning. For example, a system can generate an alarm when a device is overheating. In this example, the system can transmit a notification to a user when the alarm is generated. The previous systems can be pre-configured with instructions for when to generate an alarm and when to transmit a notification for the alarm. For example, a system can include pre-configured alarm set points or threshold values that can be utilized to generate an alarm when a value for the system meets or exceeds an alarm set point. As used herein, an alarm set point or threshold value can be a value for the system that is outside a manufacturer recommended value.

In some examples, it can be difficult to reconfigure or change the pre-configured instructions of the system to alter the alarm set points or threshold values of the system. For example, an administrator for the system may not have access to change the pre-configured instruction and thus there may not be a way to alter the set points or threshold values for the system without altering the pre-configured instructions, which may not be accessible for the administrator or other end user of the system.

The alarm and notification generation described herein can enable an administrator of a system to alter the pre-configured alarm set points and/or generate additional set points or threshold values for the system. For example, an alarm template can be generated for the system. The alarm template can include a plurality of set points and/or threshold values for the system, a plurality of notification templates, and/or user profile data. The alarm template can be utilized to customize alarm and notification generation for the system. For example, the alarm template can be utilized to generate custom set points, custom threshold values, custom special points, custom notifications, and/or custom recipients for each of the notifications.

In the following detailed description, reference is made to the accompanying drawings that form a part hereof. The drawings show by way of illustration how one or more embodiments of the disclosure may be practiced.

These embodiments are described in sufficient detail to enable those of ordinary skill in the art to practice one or more embodiments of this disclosure. It is to be understood that other embodiments may be utilized and that process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure, and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits.

As used herein, "a" or "a number of" something can refer to one or more such things. For example, "a number of users" can refer to one or more users. Additionally, the designator "N", as used herein, particularly with respect to reference numerals in the drawings, indicates that a number of the particular feature so designated can be included with a number of embodiments of the present disclosure.

FIG. 1 is an example of a system 100 for alarm and notification generation according to one or more embodiments of the present disclosure. In some examples, the system 100 can include a computing device 102. The computing device 102 can be a server or remote computing device that can be utilized for generating alarms and notifications for a plurality of systems. For example, the system 100 can be utilized to generate alarms at custom set points and/or threshold values for one or more HVAC systems. In another example, the system 100 can be utilized to generate custom notifications when an alarm is generated and to transmit the custom notifications to specific devices and/or specific users based on a user profile.

In some examples, the computing device 102 can include an alarm engine 104, a rule engine 106, and/or a template parser 108 that can include executable instructions that when executed by a processor, can perform a number of functions described herein. In some examples, the computing device 102 can receive alarm files 112. The alarm files 112 can include a plurality of alarm set points for a particular system. For example, the alarm files 112 can include pre-configured alarm set points and/or pre-configured threshold values for the particular system.

In some examples, the alarm files 112 can be set points and/or threshold values for the system that are set by a manufacturer of the particular system. In some examples, the alarm set points can be compared to real time values for the system to determine when a system is performing outside manufacturer specifications. For example, the alarm set points can be threshold values and/or value ranges that can represent when there is a system failure or when the system is performing abnormally (e.g., outside manufacturer recommendations, etc.). In some examples, the rule engine 106 can receive or extract the alarm files 112 from the particular system. For example, the particular system can include a storage medium that can be utilized to store the alarm files 112. In this example, the rule engine 106 can receive or extract the alarm files 112 from the storage medium of the system.

In some examples, the computing device 102 can include a template parser 108. The template parser 108 can receive or extract an alarm rule template 114. The alarm rule template 114 can include custom threshold values and custom notification settings for alarm and notification generation. For example, the alarm rule template 114 can be utilized to define threshold values for a particular system. In some examples the custom threshold values can be special points that when met or exceeded by the system can trigger an alarm or notification as described herein. The defined threshold values can be utilized to identify when a device or the system is performing outside manufacturer specifications or outside preferred specifications of an administrator or end user of the system.

In some examples, the defined threshold values can include a plurality of value ranges that when met or exceeded by the particular system can initiate a generation of an alarm. In some examples, an administrator can add an additional threshold value to the plurality of threshold values from the alarm rule template 114 via the computing device 102. In some examples, threshold values from the alarm rule template 114 can be removed by an administrator via the computing device 102. In some examples, the added additional threshold value can be parsed with the plurality of threshold values and the plurality of alarm set points as described herein.

In some examples, the alarm rule template 114 can be utilized to generate additional threshold values for the particular system and/or disable a number of the alarm set points of the particular system. For example, the alarm rule template 114 can include a plurality of customized alarm set points for the particular system that are different than the pre-configured alarm set points of the particular system.

In some examples, the alarm rule template 114 can be utilized by the template parser 108. For example, the template parser 108 can utilize the alarm rule template 114 to generate a parse tree of the threshold values within the alarm rule template 114. In some examples, the parse tree can be a structure that identifies the relationships of the data within the alarm rule template 114. For example, the parse tree can be used to identify relationships between custom threshold values, custom notifications, and/or user profile data from the alarm rule template 114. In some examples, a particular custom threshold value, a particular custom notification, and a particular user profile can be grouped by the parse tree. In these examples, a particular group can be utilized to identify an alarm based on the particular custom threshold value, identify a particular custom notification based on the alarm, and identify a particular user or group of users to transmit the custom notification based on the user profile data.

In some examples, the parse tree from the template parser 108 and the alarm files 112 from the rule engine 106 can be utilized to generate a data structure 110. For example, the template parser 108 can generate a rule data structure for a system that includes a plurality of alarm set points for the system and a plurality of additional threshold values from the alarm rule template 114 for the system. In some examples, the alarm rule template 114 can include a decision table that can be utilized to determine when to generate an alarm, generate a notification, and/or transmit a notification based on a value of the system. In some examples, the decision table can be included within the data structure. In some examples, the method 240 as referenced in FIG. 2 can be an example of a decision table.

The data structure 110 can be a similar structure to the parse tree generated by the template parser 108. For example, the data structure 110 can include a plurality of threshold values that include the custom threshold values of the alarm rule template 114 and the alarm set points from the alarm files 112. That is, the data structure 110 can be a data structure that includes the manufacturer alarm files 112 and the custom data from the alarm rule template 114. For example, the computing device 102 can combine the plurality of alarm set points from the alarm files 112 with the alarm rule template 114 to generate the data structure 110.

The data structure 110 can be utilized by the alarm engine 104 of the computing device 102. In some examples, the alarm engine 104 can be utilized to monitor data values of a system corresponding to the alarm files 112 and/or the alarm rule template 114 to determine when a value of the system meets or exceeds a set point of the alarm files 112 and/or the threshold values of the alarm rule template 114. For example, the alarm engine 104 can monitor system values for the system corresponding to the plurality of alarm set points and the plurality of additional threshold values. In some examples, the alarm engine 104 can generate an alarm when a value of the system meets or exceeds the set point and/or threshold values. In these examples, the alarm engine 104 can generate a notification based on the set point and/or threshold value that was met or exceeded by the system.

In some examples, the alarm engine 104 can utilize the data structure 110 to generate alarms and notifications as described herein. For example, the alarm engine 104 can utilize the data structure 110 to determine when a temperature value of the system exceeds a temperature threshold value or set point of the data structure 110. In this example, the alarm engine 104 can utilize the data structure 110 to generate an alarm when the alarm engine 104 determines that the temperature value of the system has exceeded a temperature threshold value or set point of the data structure 110. In this example, the alarm engine 104 can generate a notification based on the temperature threshold value or set point of the data structure 110.

As described herein, a particular type of notification can be generated based on a corresponding threshold value or set point that was met or exceeded by the system. For example, the data structure 110 can include a plurality of temperature thresholds or set points that can each correspond to a particular alarm level. As used herein, an alarm level can be a rating of urgency that corresponds to a threshold value or set point. For example, a normal operating temperature of a device within a system can be 70 degrees Fahrenheit. In this example, a first temperature threshold or set point can be set for 75 degrees Fahrenheit with a corresponding first alarm level, a second temperature threshold or set point can be set for 80 degrees Fahrenheit with a corresponding second alarm level, and a third temperature threshold or set point can be set for greater than or equal to 85 degrees Fahrenheit with a corresponding third alarm level. In this example, the first alarm level can have a relatively low urgency, the second alarm level can have a relatively medium urgency, and the third alarm level can have a relatively high urgency. In some examples, a type of notification generated by the alarm engine 104 can correspond to a particular threshold value met or exceeded by the system and/or can correspond to a particular alarm level or urgency of the generated alarm.

In some examples, the alarm engine 104 can determine a user or group of users to transmit the generated notification based on user profile data within the data structure 110. In some examples, the data structure 110 can group particular user profile data with corresponding types of notifications and/or alarm levels associated with particular threshold values or set points. In some examples, each alarm level or notification type can have a corresponding user or group of users. In these examples, the alarm engine 104 can determine a user or group of users for transmitting the generated notification based on the data structure 110. For example, the alarm engine 104 can generate a first type of notification with a first alarm level and transmit the first type of notification to a first group of users. In this example, the alarm engine 104 can generate a second type of notification with a second alarm level and transmit the second type of notification to a second group of users. In this example, the first type of notification can be relevant to the first group of users, but may not be relevant to the second group of users. In addition, the second type of notification can be relevant to the second group of users, but may not be relevant to the first group of users.

In some examples, the alarm engine 104 can generate a second type of notification when the system values do not meet or exceed the plurality of alarm set points from the alarm files, but meet or exceed the threshold values of the alarm rule template 114. For example, a first type of notification can be generated when manufacturer set points are met or exceeded and a second type of notification can be generated when a custom threshold or set point is met or exceeded by the system.

In some examples, the system 100 can include a building automation system (BAS) 116. The BAS 116 can be utilized to monitor data of a building, HVAC unit, and/or other systems and devices. In some examples, the BAS 116 can be utilized to monitor real time data and/or provide real time values of a system to a change of value (COV) queue 118. In some examples, the BAS 116 can receive real time data and/or real time values for a system via a number of sensors that are connected or in communication with devices of the system. The BAS 116 can be in communication with the sensors to receive the data and/or values for the system.

In some examples, the COV queue 118 can monitor value changes over time. For example, the COV queue 118 can monitor and store values of a particular system for a period of time. The COV queue 118 can provide the system values to the alarm engine 104 and/or can proved change values for the system. In some examples, the alarm engine 104 can utilize the system values and/or change values from the COV queue 118 to determine when a set point or threshold value within the data structure 110 has been met or exceeded.

As described herein, the alarm engine 104 can generate an alarm and/or notification when a value from the COV queue 118 meets or exceeds a set value or threshold value within the data structure 110. When the alarm and/or notification are generated by the alarm engine 104, the notification can be sent to an alarm queue 122 for transmitting to a user or group of users as described herein. In some examples, the alarm queue 122 can provide a queue of notifications to be transmitted to a user or group of users based on the type of notification and/or a user profile of the user or group of users.

In some examples, the alarm queue 122 can be connected to a web 120 (e.g., network, local area network, wide area network, Internet, etc.). The alarm queue 122 can utilize the web 120 to transmit the generated notifications to the user and/or group of users. For example, the alarm queue 122 can transmit messages to a user and/or a group of users via the web 120.

As described herein, the system 100 can be utilized to combine pre-configured alarm files 112 of a system with a custom alarm rule template 114 to customize alarm and notification generation for the system without having to change the alarm files 112 of the system. As described herein, changing pre-configured alarm files 112 of a system can be difficult or not possible, which can make adding or removing set points and/or threshold values for the system difficult. In addition, the system 100 can be utilized to monitor a plurality of remote systems and customize the set points and/or threshold values for the plurality of remote systems without having to manually alter each of the plurality of remote systems.

Figure 2:
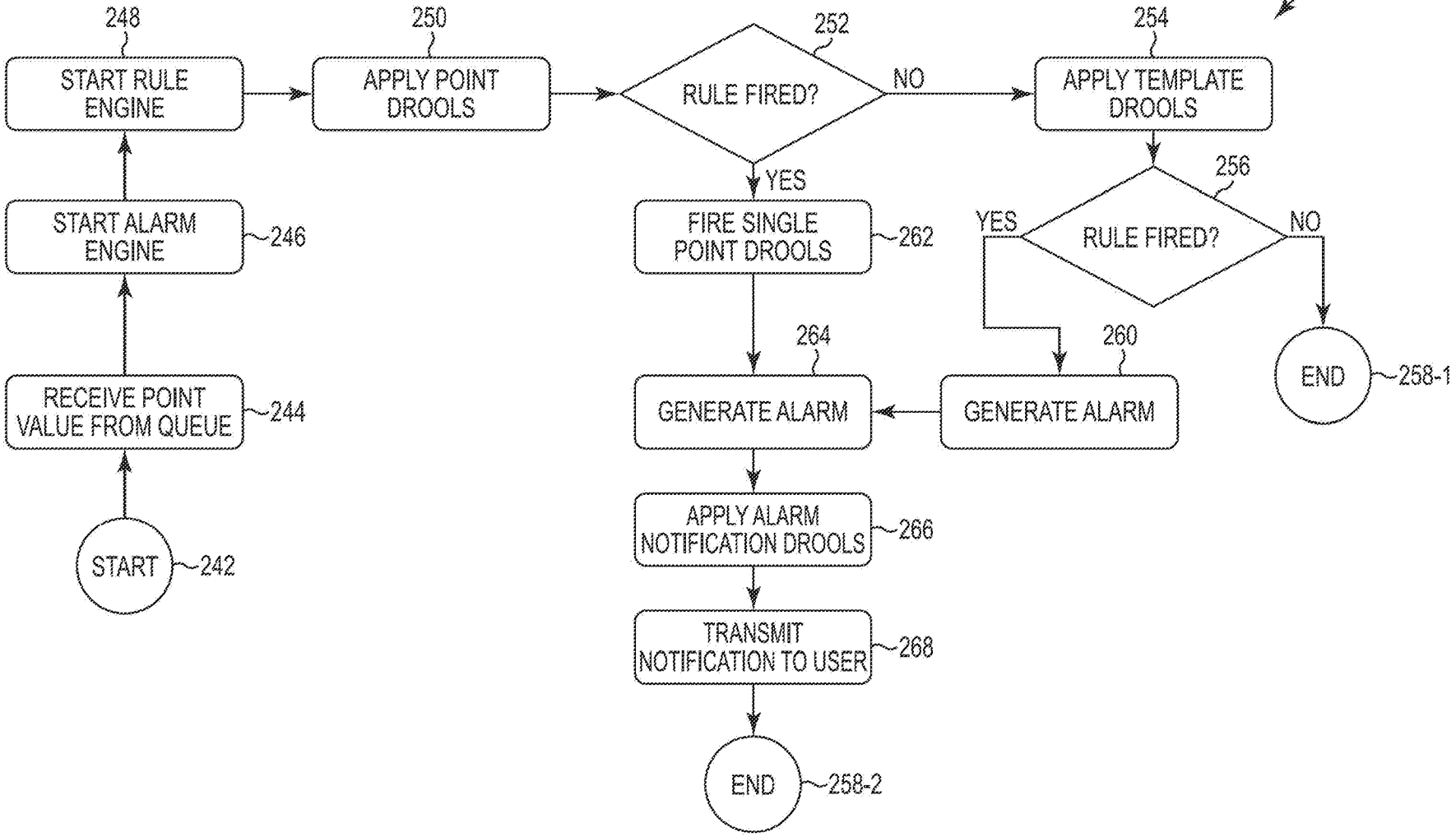
FIG. 2 is an example of a method for alarm and notification generation according to one or more embodiments of the present disclosure.

FIG. 2 is an example of a method 240 for alarm and notification generation according to one or more embodiments of the present disclosure. In some examples, the method 240 can be utilized to determine when a value for a system meets or exceeds a set point or threshold value within a data structure as described herein. In some examples, the method 240 can be performed by a computing device as described herein.

At block 242 the method 240 can start. At block 244 the method 240 can include receiving a point value (e.g., system value at a particular point in time, change value at a particular point in time, etc.) from a queue (e.g., COV queue 118 as referenced in FIG. 1, etc.). For example, a computing device with an alarm engine can receive a point value that represents a state of the system from a COV queue. In this example, the point value can represent a temperature or change in temperature value that can represent a state of an HVAC system or device of the HVAC system. In some examples, the point value can be received from an automation system (e.g., BAS, etc.) that monitors real time data of the system.

At block 246 the method 240 can include starting the alarm engine of a computing device. As described herein, the alarm engine can be utilized to generate alarms and/or notifications when a point value received by a queue meets or exceeds a threshold or set point value defined in a data structure. At block 248 the method 240 can include starting the rule engine of the computing device. As described herein, the rule engine can receive or extract alarm files from a system. The alarm files can include pre-configured set points and/or threshold values for a system.

At block 250 the method 240 can include applying point drools. As used herein, applying point drools can include applying the pre-configured rules from the system. A point drool is one example of a business rule management system that can be utilized by an alarm engine of a computing device to utilize a data structure that includes data from the alarm files. In some examples, the data structure can include both the data from the alarm files and the data from the alarm rule template. However, in other examples, the method 240 can utilize a first data structure for data from the alarm files and a second data structure for data from the alarm rule template.

At block 252 the method 240 can include determining if a rule from the alarm files is fired. As used herein, an alarm is fired or generated when a value of the system meets or exceeds the rule. As used herein, the rule from the alarm files can be a set point or threshold value of the system. When a rule is not fired the method 240 can move to block 254 and when a rule is fired the method 240 can move to block 262.

When a rule is not fired at 252, the method can move to block 254. At block 254 the method 240 can include applying template drools. In some examples, applying template drools can include applying the set points and/or threshold values of the alarm rule template. In some examples, applying template drools can include utilizing a data structure that includes the set points and/or threshold values of the alarm rule template. When a rule is not fired at 256 the method 240 can move to block 258-1 and end or restart at block 242.

When a rule is fired at block 256, the method 240 can move to block 260. At block 260 the method 240 can fire a template drool corresponding to the rule that was fired at block 256. For example, when a threshold value is met or exceeded at block 256, the method 240 can execute the template drools corresponding to the threshold value. When the template drool is fired at 260 the method 240 can move to block 264. In some examples, when a rule is fired at block 252 the method 240 can move from block 252 to block 262 where the method 240 can include firing a single point drool. As used herein, firing a single point drool can include executing single point drools corresponding to a point value meeting or exceeding a pre-configured set point or threshold value of the system.

At block 264 the method 240 can include generating an alarm corresponding to either the single point drool from block 262 and/or the template drool fired at block 260. As described herein, generating an alarm can provide an indication that a value of the system meets or exceeds a set point and/or threshold value of the system. When the alarm is generated at block 264 the method 240 can move to block 266.

At block 266 the method 240 can apply alarm notification drools. As used herein, applying notification drools can include generating a notification corresponding to the generated alarm at block 264. In some examples, applying the alarm notification drools can include generating a particular type of notification based on a generated data structure. In some examples, applying the alarm notification drools can include determining a user or group of users for transmitting a notification. When the alarm notification drools are applied, the method 240 can move to block 268.

At block 268 the method 240 can transmit the notification to a user. As described herein, the notification can be sent to a single user or a group of users. The particular user or group of users can be defined based on the type of notification and/or user profile of the user or group of users, as described herein. When the notification is transmitted to a user or group of users, the method 240 can move to block 258-2.

The method 240 can be utilized to combine pre-configured alarm files 112 of a system with a custom alarm rule template 114 to customize alarm and notification generation for the system without having to change the alarm files 112 of the system. As described herein, changing pre-configured alarm files 112 of a system can be difficult or not possible, which can make adding or removing set points and/or threshold values for the system difficult. In addition, the system 100 can be utilized to monitor a plurality of remote systems and customize the set points and/or threshold values for the plurality of remote systems without having to manually alter each of the plurality of remote systems.

Figure 3:
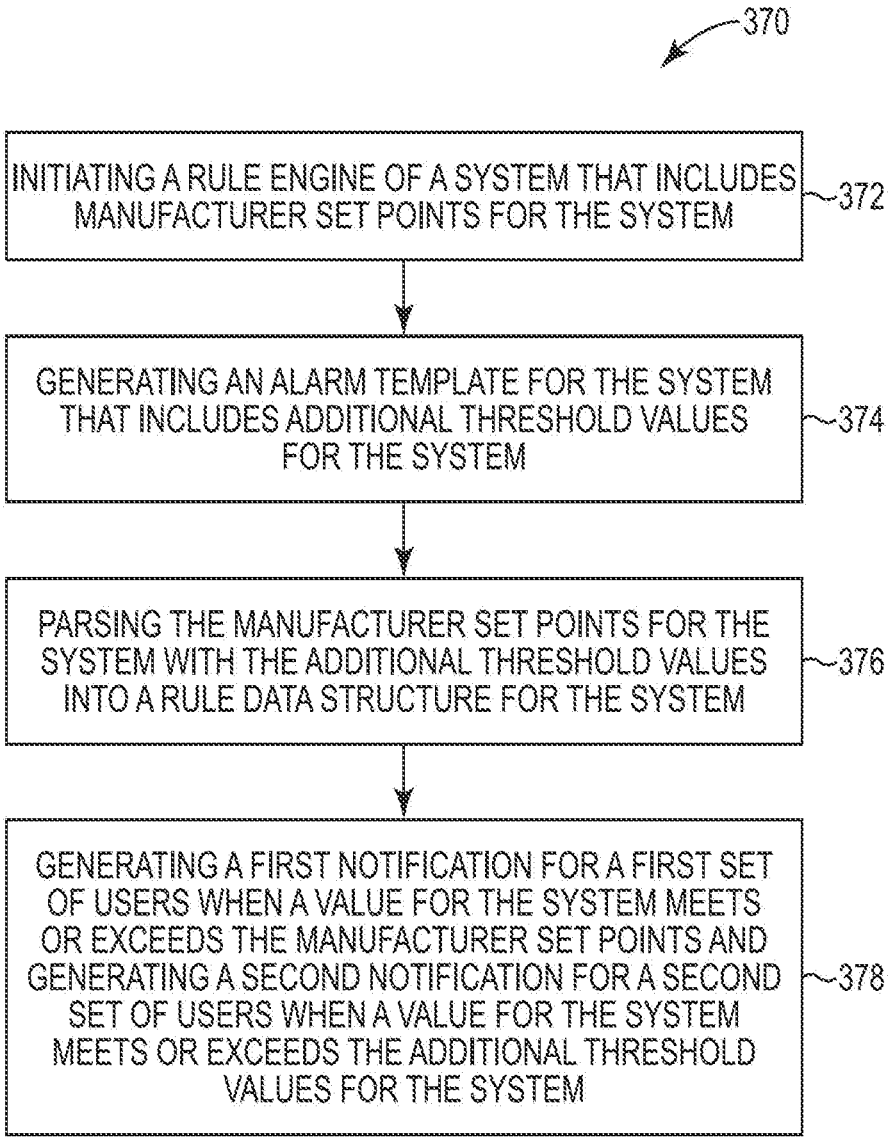
FIG. 3 is an example of a method for alarm and notification generation according to one or more embodiments of the present disclosure.

FIG. 3 is an example of a method 370 for alarm and notification generation according to one or more embodiments of the present disclosure. The method 370 can be utilized to customize alarm and notification generation for a system. In some examples, the method 370 can be performed by a computing device.

At block 372 the method 370 can include initiating a rule engine of a system that includes manufacturer set points for the system. As described herein, initiating the rule engine of the system can include starting the rule engine (e.g., rule engine 106 as referenced in FIG. 1, etc.) of a computing device that includes pre-configured set points for the system. In some examples, the rule engine can receive or extract the pre-configured set points from a computing device in communication with the system. In some examples, initiating the rule engine can apply the pre-configured set points of the system for an alarm engine (e.g., alarm engine 104 as referenced in FIG. 1, etc.).

At block 374 the method 370 can include generating an alarm template for the system that includes additional threshold values for the system. As described herein, an alarm template (e.g., alarm rule template 114 as referenced in FIG. 1, etc.) can be generated by an administrator of the system. In some examples, the alarm template can include custom threshold values or set points for the system. For example, an administrator of the system can generate an alarm template that includes a plurality of custom threshold values or set points for the system.

The alarm template can include a plurality of notification types for transmitting to users and/or devices when a corresponding alarm is generated by the alarm engine. In some examples, the alarm template can include user profile data. The user profile data can be utilized for transmitting the notification to a user or group of users. For example, a particular notification type or alarm type can correspond to a particular user profile and the notification can be sent to users with the particular user profile. In some examples, the method 370 can include transmitting the first type of notification to a first user based on a user profile of the first user and transmitting the second type of notification to a second user based on a user profile of the second user. The user profile can identify a job, a status within a hierarchy, a list of abilities of the user, a list of qualifications of the user, a work history of the user, among other information about the user that may be relevant to a particular alarm.

At block 376 the method 370 can include parsing the manufacturer set points for the system with the additional threshold values into a rule data structure for the system. As described herein, parsing the manufacturer set points for the system with the additional threshold values can include generating a data structure for the system that includes the manufacturer set points for the system and the additional threshold values from the alarm template. In these examples, the data structure can be utilized by the rule engine to determine when a set point or threshold value has been met or exceeded by the system. In some examples, the method 370 can include saving the parsed additional threshold values and alarm set points into a data structure for the system.

At block 378 the method 370 can include generating a first notification for a first set of users when a value for the system meets or exceeds the manufacturer set points and generating a second notification for a second set of users when a value for the system meets or exceeds the additional threshold values for the system. In some examples, the first notification can be generated the rule engine and the second notification can be generated by the alarm template.

In some examples, a portion of the first notification is generated by the alarm template. For example, a portion of the first notification can be generated by the alarm engine based on the manufacturer set points and a portion of the first notification can be generated based on the rule template. In this example, the portion of the first notification generated based on the rule template can be a type of notification that is generated and the determined user or group of users that receive the notification.

In some examples, the method 370 can include defining each of the manufacturer set points with a corresponding list of user profiles for sending notifications to when a manufacturer set point is met or exceeded by a value for the system. In some examples, the method 370 can include identifying information to be provided within the first notification and the second notification. In some examples, the method 370 can include identifying user specific information to be provided within the first notification and the second notification.

The method 370 can be utilized by a computing device to alter the plurality of threshold values of the alarm template without altering instructions of the system. Thus, manufacturer instructions do not need to be altered in order to customize the alarm and notification generation settings of the system.

Figure 4:
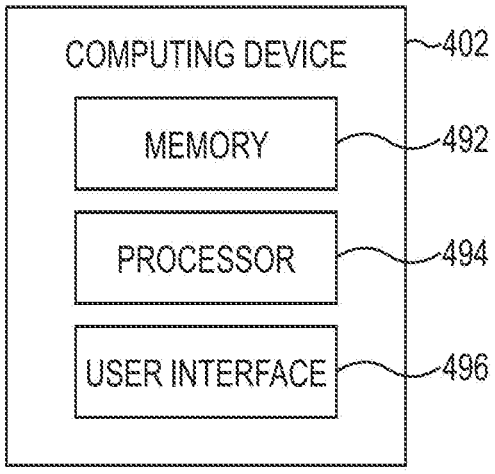
FIG. 4 is an example of a computing device for alarm and notification generation according to one or more embodiments of the present disclosure.

FIG. 4 is an example of a computing device 402 for alarm and notification generation according to one or more embodiments of the present disclosure. Computing device 402 can be, for example, a commodity server, a data center that comprises a plurality of servers, among other types of computing devices or embedded system. Computing device 402 can be utilized in system 100, method 240, and/or method 370 to perform the functions previously described herein. For example, computing device 402 can be computing device 102 as referenced in FIG. 1.

As shown in FIG. 4, computing device 402 includes a memory 492 and a processing resource 494 (e.g., processor) coupled to memory 492. Memory 492 can be any type of storage medium that can be accessed by processing resource 494 to perform various examples of the present disclosure. For example, memory 492 can be a non-transitory computer readable medium having computer readable instructions (e.g., computer program instructions) stored thereon that are executable by processing resource 494 to perform generating alarms and notifications in accordance with one or more embodiments of the present disclosure.

Memory 492 can be volatile or nonvolatile memory. Memory 492 can also be removable (e.g., portable) memory, or non-removable (e.g., internal) memory. For example, memory 492 can be random access memory (RAM) (e.g., dynamic random access memory (DRAM) and/or phase change random access memory (PCRAM)), read-only memory (ROM) (e.g., electrically erasable programmable read-only memory (EEPROM) and/or compact-disc read-only memory (CD-ROM)), flash memory, a laser disc, a digital versatile disc (DVD) or other optical disk storage, and/or a magnetic medium such as magnetic cassettes, tapes, or disks, among other types of memory.

Further, although memory 492 is illustrated as being located in computing device 402, embodiments of the present disclosure are not so limited. For example, memory 492 can also be located internal to another computing resource (e.g., enabling computer readable instructions to be downloaded over the Internet or another wired or wireless connection).

As shown in FIG. 4, computing device 402 can also include a user interface 496. User interface 496 can include, for example, a display (e.g., a screen). The display can be, for instance, a touch-screen (e.g., the display can include touch-screen capabilities). User interface 496 (e.g., the display of user interface 496) can provide (e.g., display and/or present) information to a user of computing device 402.

Additionally, computing device 402 can receive information from the user of computing device 402 through an interaction with the user via user interface 496. For example, computing device 402 (e.g., the display of user interface 496) can receive input from the user via user interface 496. The user can enter the input into computing device 402 using, for instance, a mouse and/or keyboard associated with computing device 402, or by touching the display of user interface 496 in embodiments in which the display includes touch-screen capabilities (e.g., embodiments in which the display is a touch screen).

As described herein, an "engine" can include computer readable instructions that can be executed by a processing resource to perform a particular function. An engine can also include hardware, firmware, and/or logic that can perform a particular function.

As used herein, "logic" is an alternative or additional processing resource to execute the actions and/or functions, described herein, which includes hardware (e.g., various forms of transistor logic, application specific integrated circuits (ASICs)), as opposed to computer executable instructions (e.g., software, firmware) stored in memory and executable by a processing resource.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above elements and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed:

1. A computing device for alarm and notification generation, comprising:

a memory; and a processor configured to execute executable instructions stored in the memory to:

identify a plurality of manufacturer alarm set points for a system, wherein the plurality of manufacturer alarm set points include manufacturer defined alarm threshold values for the system;

allow a user to generate an alarm template for the system, wherein the alarm template includes additional alarm threshold values for the system beyond the manufacturer defined alarm threshold values;

generate a rule data structure that combines the plurality of manufacturer alarm set points for the system including the manufactuere defined alarm threshold values with the additional alarm threshold values for the system of the alarm template;

generate a first notification when a value for the system meets or exceeds a manufacturer defined alarm threshold value of the plurality manufacturer alarm set points; and generate a second notification when the value for the system meets or exceeds the additional alarm threshold values of the alarm template for the system.

2. The computing device of claim 1, wherein the additional alarm threshold values include customized threshold values for the system.

3. The computing device of claim 1, wherein the processor is configured to execute the instructions to parse the additional alarm threshold values with the plurality of manufacturer defined alarm threshold values.

4. The computing device of claim 3, wherein the processor is configured to execute the instructions to save the parsed additional alarm threshold values and the plurality of manufacturer defined alarm threshold values into a data structure for the system.

5. A non-transitory computer readable medium, comprising instructions executable by a processing resource to:

generate a rule data structure for a system that includes a plurality of manufacturer alarm set points include manufacturer defined alarm threshold values for the system and a plurality of additional alarm threshold values from an alarm template for the system by a user;

monitor system values for the system corresponding to the plurality of manufacturer defined alarm threshold values and the plurality of additional threshold values;

generate a first type of notification when the system values meet or exceed one or more of the plurality of manufacturer defined alarm threshold values; and generate a second type of notification when the system values meet or exceed one or more of the plurality of additional alarm threshold values.

6. The medium of claim 5, wherein the alarm template is a rule template that includes a decision table.

7. The medium of claim 5, wherein the instructions are executable by the processing resource to generate the first type of notification when the system values do not meet or exceed the plurality of additional alarm threshold values.

8. The medium of claim 5, wherein the instructions are executable by the processing resource to transmit the first type of notification to a first user and transmit the second type of notification to a second user.

9. The medium of claim 5, wherein the instructions are executable by the processing resource to alter one or more of the plurality of additional alarm threshold values of the alarm template without altering instructions of the system.

10. The medium of claim 5, wherein the instructions are executable by the processing resource to transmit the first type of notification to a first user based on a user profile of the first user and transmit the second type of notification to a second user based on a user profile of the second user.

11. The medium of claim 5, wherein the instructions are executable by the processing resource to add an additional alarm threshold value to the plurality of additional alarm threshold values from the alarm template.

12. The medium of claim 11, wherein the instructions are executable by the processing resource to parse the added additional alarm threshold value with the plurality of additional alarm threshold values and the plurality of manufacturer defined alarm threshold values.

13. A method for alarm and notification generation, comprising:

initiating a rule engine of a system that includes manufacturer alarm set points including manufacturer defined alarm threshold values for the system for the system;

allowing a user to generate an alarm template for the system that includes additional alarm threshold values for the system beyond the manufacturer defined alarm threshold values;

parsing the manufacturer defined alarm threshold values for the system with the additional alarm threshold values into a rule data structure for the system; and generating a first notification for a first set of users when a value for the system meets or exceeds one or more of the manufacturer defined alarm threshold values and generating a second notification for a second set of users when a value for the system meets or exceeds one or more of the additional alarm threshold values for the system.

14. The method of claim 13, comprising assigning each of the manufacturer defined alarm threshold values to a corresponding list of user profiles for sending first notifications to when a manufacturer defined alarm threshold value is met or exceeded by a value for the system.

15. The method of claim 13, wherein the first notification is generated by the rule engine and the second notification is generated by the alarm template.

16. The method of claim 13, wherein a portion of the first notification is generated by the alarm template.

17. The method of claim 13, wherein generating the alarm template includes identifying information to be provided within the first notification and the second notification.

18. The method of claim 17, wherein identifying information to be provided within the first notification and the second notification includes identifying user specific information to be provided within the first notification and the second notification.

* * * * *